United States Patent [19]

Fuller

[11] 4,081,203

[45] Mar. 28, 1978

[54] DRILL STRING STABILIZER

[75] Inventor: John Michael Fuller, Cheltenham, England

[73] Assignee: L. M. van Moppes & Sons Limited, Basingstoke, England

[21] Appl. No.: 682,971

[22] Filed: May 4, 1976

[30] Foreign Application Priority Data

May 6, 1975 United Kingdom ..... 18998/75

[51] Int. Cl.[2] ..... F16C 1/26

[52] U.S. Cl. ..... 308/4 A; 24/263 D; 175/325

[58] Field of Search ..... 308/4 A, 4 R, DIG. 5, 308/DIG. 8, DIG. 9; 175/325; 24/136 B, 263 DC, 263 DD, 263 SC, 263 D

[56] References Cited

U.S. PATENT DOCUMENTS

| | | | |
|---|---|---|---|
| 3,820,611 | 6/1974 | King | 308/4 A |
| 4,000,549 | 1/1977 | Brumley et al. | 308/4 A |

*Primary Examiner*—Richard A. Bertsch

*Attorney, Agent, or Firm*—Shoemaker and Mattare, Ltd.

[57] ABSTRACT

The invention provides a stabilizer having integral steel blades with preformed apertures into which are cold pressed plugs of hard material, which is characterized in that some of the plugs of hard material inserted into the preformed holes in each blade, each have embedded therein and located exposed at the outer surface thereof, at least one diamond. Advantageously the diamond containing plugs are particularly located so that they are concentrated in those regions of the blade which, when the stabilizer is used in a borehole, are subjected to the greatest wear, viz. towards the leading end of each blade and at sharp changes of contour.

16 Claims, 5 Drawing Figures

DRILL STRING STABILIZER

In drilling deep holes in the ground such as are required for oil or gas wells, it is common practice to use a rotating drilling bit, driven by a long assembly, known as a drill string. This consists of numerous elements inter-engaged by means of screwed connections.

All the drill string components are hollow and transmit drilling fluid or mud under pressure to cool the bit and carry the cuttings.

In some cases, a downhole mud turbine or hydraulic motor is inserted in the string between the bit and the drill collars to use hydraulic power of the drilling fluid pumped through the drill string to rotate the bit, usually at a higher speed than can be achieved by rotation of the string.

It has now become common practice to include in the drill string elements known as "stabilizers". A stabilizer in this context consists of an element of the drill string having screwed or other connections top and/or bottom for engagement with other drill string components, the stabilizer element being generally of hollow cylindrical form, part of whose outer surface consists of a plurality of ribs or "blades" between which the drilling fluid if free to pass up the annulus.

A stabilizer may be used in the string located near the bit and/or at any other location intermediate of the length of the drill string.

All the drill string components except the bit and the stabilizer have outside diameters smaller than that of the hole made by the bit.

One function of such a stabilizer is to centralise the neighbouring drill string components in the hole, thus preventing or reducing whip and vibration and wear of other components. A most important function of such a stabilizer can be to control the direction of drilling or changes in such direction in both elevation and azimuth. This latter has become particularly important in drilling a number of directional wells from one site (or offshore platform). This control is achieved by variation of the position of a stabilizer or stabilizers in the bottom hole assembly and by variation also of weight on the bit and other features such as the relationship between bit and stabilizer diameters. A combination of these variables with the properties of the formation being drilled, influences the gradual building or loss of elevation angle and turning left or right in azimuth.

The outer surfaces of the stabilizer blades in contact with the wall of the hole form an interrupted cylinder. Naturally these surfaces, which rub on the formation, are subject to wear.

To minimise the rate of wear, it has sometimes been the practice to use special hard facing materials for all or part of the working surface of the stabilizer blades. Materials such as tungsten carbide are commonly used. This wear is particularly severe when a stabilizer rotates at very high speed in hard and abrasive formation such as occurs with a "near bit stabilizer" used immediately above a bit driven by a downhole turbine.

Two methods of rendering the ribs of a stabilizer resistant to wear have involved either manufacturing the stabilizer as a single steel part with its main steel body integral with its steel blades and attaching bodies of hard material such as tungsten carbide to the blades; or, manufacturing the stabilizer in multipart form with a blade portion or portions being made separately, possibly in the form of a sleeve, with hard material affixed thereto, the blade portion or portions being subsequently connected to the remaining components of the stabilizer. The former prior proposal has not been entirely satisfactory in avoiding abrasive wear. On the other hand, a multi-part construction has great complexity with a large number of components liable to possible failure.

Another well known method of making a stabilizer with a wear resistant surface is to make it of suitable steel and to press inserts of tungsten carbide into holes in the surface of the blades.

An advantage of this method of construction is that the steel body and blades can be made in one piece, reducing the risk of breakage. A further advantage is that the steel can be hardened and tempered generally and locally, the surface of the blades being hard, and screwed connections being tough, and that the conditions obtained by heat treatment are not affected by pressing in the inserts. This is in contrast with any process which takes the steel above its critical temperature, upsetting its mechanical properties.

The tungsten carbide inserts are normally plugs made by sintering from tungsten carbide powder with additions such as cobalt. These known plugs may be of generally cylindrical form with a tapered end facilitating insertion, by pressing, into the holes preformed in the blades of the stabilizer.

The present invention is exclusively concerned with a drill string stabilizer, which may be a near bit stabilizer, which is of known kind in that it comprises an elongate steel body having connections by which the stabilizer may be assembled in a drill string, the stabilizer having integrally a plurality of steel blades which define outer borehole engaging surfaces of the stabilizer, which surfaces with intervening grooves form an interrupted cylinder, and each blade having a tapered leading end, and wherein there are formed both on the tapered leading end of each blade and on the outer borehole engaging surface of each blade a number of blind holes each occupied by a plug of material which is harder than steel, with each plug being cold pressed into a said preformed blind hole so that the outer surface of the plug is substantially flush with the surface of the blade.

The present invention has for its object to provide such a stabilizer with means enabling it to be heavily resistant to wear and which avoids any heating of the stabilizer body or blades which may be highly disadvantageous by reducing the mechanical properties of the steel for example due to differential contraction.

According to the invention some of the plugs of hard material inserted into the preformed holes in each stabilizer blade each have embedded therein and located exposed at their outer surface thereof, that is at the end of the plug adapted to be located at the outer edge of a stabilizer blade, at least one diamond.

Typically the diamond size may range from 1/20 carat to 2 carats and the diamond may be natural or synthetic, or even a crystalline substance with a hardness close to that of diamond such as cubic boron nitride.

Preferably each plug has four or more diamonds at its outer face and the diamonds are preferably generally cubic in the larger particle sizes of ⅛, 1/5 or even ½ carat and preferably the diamonds are orientated diagonally with respect to the intended direction of motion of the plug relative to the borehole wall.

The invention provides then a stabilizer formed in one piece with a steel body integral with its steel blades and having hard plugs, and as aforementioned, at least some of these plugs will have diamonds, the hard plugs being pressed, without accompanying applied heat, into pre-drilled holes in the blades. The blades will have tapered leading and may also have tapered trailing ends and at least the leading ends may also be drilled and have hard plugs inserted therein some of these plugs having diamonds.

The diamonds need to be located at the working surfaces of the plugs in order to establish certain required dimensions of the stabilizer and maintain these dimensions against wear. Although wear will take place to a greater degree in regions of softer material near the diamonds, such wear will be less than would be the case if the diamonds were not present. However, when wear of the regions with material softer than diamond has taken place, the diamonds will stand proud of the surface of the stabilizer blade. In this condition the diamonds will be less protected than prior to the wear by surrounding regions of the blade and will be subjected to mechanical shock and other forces tending to dislodge the diamonds from the means anchoring them.

Accordingly, attention needs to be given to the means by which the diamonds are anchored to the body of the plug and the quality of these anchoring means will derive mainly from the materials selected and the process by which the plugs are made According to a further aspect of the invention, one method of making a diamond containing plug is by forming a matrix of tungsten carbide at a temperature of 1000° C to 1150° C and holding the diamonds in this matrix by means of an infiltrant of molten metal alloy, suitably a copper-nickel-zinc alloy. This will result in the diamonds being held in part by shrinkage of the pores of the tungsten carbide matrix to exert a clamping action on the diamond. At the same time there will be a kind of adhesive bond between the tungsten carbide matrix and the diamond, the infiltrant alloy binding the matrix. This gives the matrix a tungsten carbide content of 65% to 70%.

A more satisfactory and wear resistant plug has been found to result from cementing a mixture of tungsten carbide powders, 10% to 25% cobalt powder and diamond under a pressure of at least 5 tons per square inch by application of heat which is held in the range 1200° C and 1450° C for between one and five minutes. The final product has a tungsten carbide content of at least 80%.

By this process the diamonds are chemically bonded to and mechanically held by the tungsten carbide cobalt matrix and the bond between diamond and matrix is strong with high tensile and impact strength.

Typically a pressure of 7 tons per square inch is employed in the cementation process and the resultant plugs are about 14 mm in length and have a grooved cylindrical external surface with a maximum diameter of about 15 mm.

In the cementation process employed the temperatures in excess of 1200° C, the temperatures at which diamonds of this size range begin to degrade, are maintained only for a very short time, namely one which will be sufficient to achieve cementation but insufficient to cause any significant degradation of the diamonds.

Preferably the application of the elevated temperatures in the range 1200° C to 1450° C will be followed by deliberate cooling which is accelerated as compared with air cooling. For example, a mould containing the plug will be rested upon a water-cooled plate.

The plug is formed in a cylindrical mould between opposed pistons or rams and the diamonds are positioned at the desired location by adhering the diamonds to a face of one of the rams which are then urged towards one another to exert on the constituent elements being cemented, the required pressure.

As aforementioned the diamonds are of at least 1/20 carat and are preferably about ½ carat. Diamonds of this latter size will have a shape which presents a flat surface which can readily be adhered to a face of a ram by gluing. At this stage the diamonds can be orientated as desired. If the diamonds are, as is preferred, cubic, they will be arranged with a diagonal orientation relative to the intended direction of motion relative to the borehole wall, as this has been found to give the greatest wear resistance in the case of plugs inserted into holes in stabilizer blades.

The plugs are intended to be cold pressed into the preformed holes in the stabilizer blades and remain securely in position. The plugs are grooved cylindrical and have maximum diameter about 5% greater than the correspondingly similar preformed holes which are deeper than the plugs. The grooves facilitate insertion of the plug and with the same intent the end of the plug which is first engaged in the hole is chamfered. The opposite end of the plug is where the diamonds are located and this end may be given a shape to conform with that of the surface of the stabilizer blade in the region surrounding the plug when the latter is located in its hole. Such shaping of the working face of the plug will preferably be accomplished during the moulding process by forming the end faces of the ram with appropriate contour.

When pressed into the holes in the stabilizer blades the plugs may have their diamonds flush with the blade surface or standing proud therefrom by up to 2 mm.

A stabilizer with a length of about 700 mm and with six blades each of 250 mm length and about 50 mm width may have as many as 500 inserted plugs of hard material. Of these plugs 450 may be plugs of cemented tungsten carbide while the remainder may contain diamond in addition.

Preferably each stabilizer blade has preformed holes filled with plugs of material harder than steel on both its outer surface and on its tapered leading end, as well as on its tapered trailing end, while of the plugs on the outer part cylindrical surface of each blade not more than 25% have diamonds embedded therein.

Preferably also, of the plugs on the tapered trailing end of each blade not more than 25% have diamonds embedded therein, while of the plugs on the tapered leading end of the stabilizer blade at least 20% have diamonds embedded therein.

The method of equipping the stabilizer blade with inserted plugs of hard material is as follows. Firstly the stabilizer blades are drilled to form holes at all locations where plugs are to be inserted. These preformed holes have a depth substantially equal to the overall length of the plugs. Those holes which are intended to contain plain plugs, (that is those without diamond) are then occupied by cold pressing the plugs using a press capable of exerting forces of say 100 tons per square inch. When all the plain plugs have been inserted, the stabilizer blades will then be subjected to a grinding operation in which any proud parts of the inserted plugs will be removed so that the plugs conform with the part cylindrical surface of each blade. The unoccupied holes will then be drilled to increase their depth to about 5% greater than the depth of the diamond plugs. The diamond plugs will then be pressed into the holes so that their diamond faced ends are substantially flush with the part cylindrical surfaces of the blades.

The invention is illustrated by way of example in the accompanying drawings in which.

Figure 1:
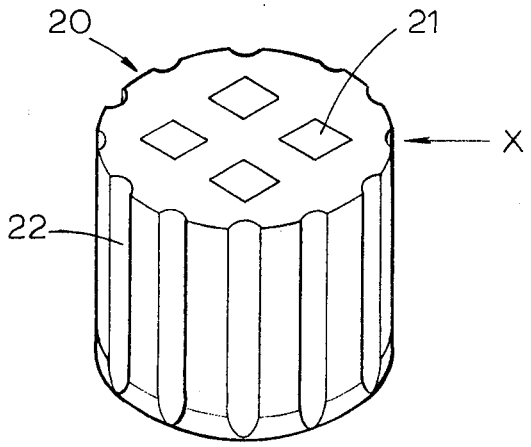
FIG. 1 is a perspective view of one embodiment of plug according to the invention intended for insertion into a preformed hole in a stabilizer blade.

Referring first to FIGS. 3, 4 and 5, 10 generally designates a stabilizer having at one end a tapered male threaded portion 11 and at the opposite end a tapered female threaded portion 12, the threaded portions 11 and 12 being integral with a main cylindrical body portion 13 of the stabilizer. Also integral with the main body portion 13 and likewise formed of hardened steel are a plurality of blades, generally designated 15, six in number in the embodiment shown. The blades are chamfered at their leading and trailing ends, 151 and 153 respectively, while their outer surfaces 152, adapted to come in contact with the wall of a drilled bore, are part cylindrical.

A plurality of blind cylindrical holes are drilled in the blades 15 opening into their outer part-cylindrical surfaces 152 and plugs of material harder than the steel are inserted into each drilled hole. Further holes may be drilled in the conically chamfered leading and trailing ends of the blades, 151 and 153 respectively, and plugs of material harder than the steel of the stabilizer may be inserted into these additional holes.

Figure 2:
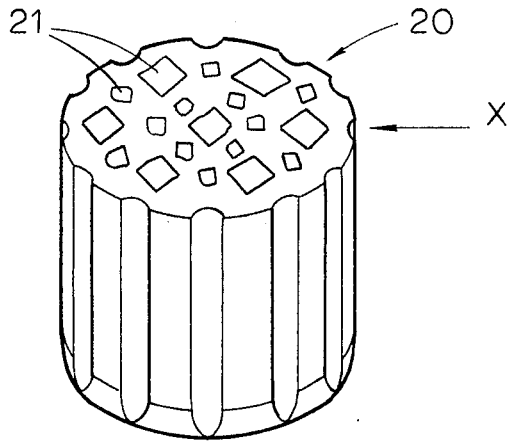
FIG. 2 is a modified form of the plug shown in FIG. 1.
Figure 4:
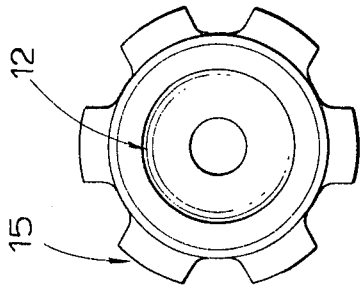
FIGS. 3 and 4 are respectively side and end views of a stabilizer having blades into preformed holes of which plugs according to the invention have been inserted.
Figure 3:
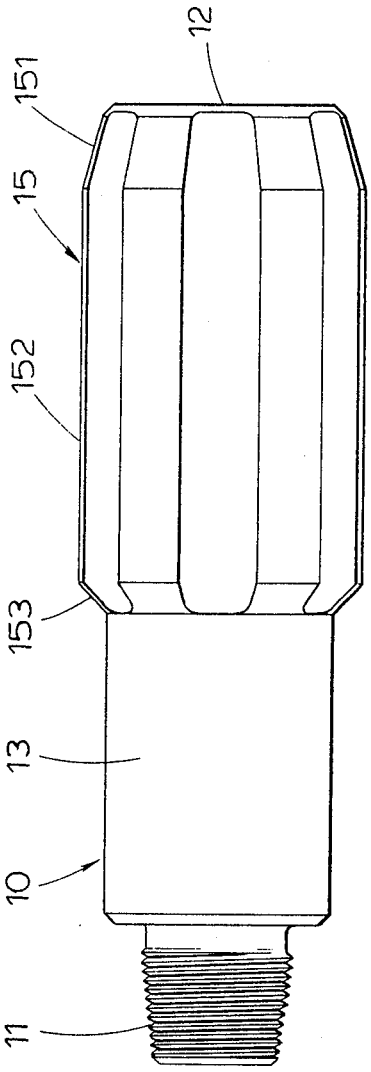

Referring now to FIGS. 1 and 2 which illustrate plugs according to the invention, these each comprise a generally cylindrical body 20 which consists of a hard metallic matrix with a plurality of diamonds held within the matrix. The diamonds 21 are preferably located at or adjacent to one end region of the generally cylindrical body 20, which end is adapted to constitute the working surface of the plug and is that end of the plug which is located flush or nearly flush with the outer surface of a stabilizer blade when the plug is inserted into preformed holes in the blade.

The plug according to the invention is intended to be inserted into the said preformed drilled holes in the stabilizer blade by being cold pressed thereinto in the absence of applied heat.

In order to facilitate such cold pressing, the cylindrical periphery of each plug may have a number of grooves 22 extending parallel to the axis of the cylindrical plug, while the end of the plug remote from that in which the diamonds 21 are located, may be chamfered conically to provide a lead into the preformed drilled hole. The overall diameter of the plug will be fractionally larger than that of the drilled hole in which it is to be inserted.

In the embodiment shown in FIG. 1, the diamonds are cubic and are of a similar size. In this embodiment the cubic diamonds are orientated diagonally with respect to the intended direction of rotation relative to a borehole wall indicated by the arrow X.

In the embodiment shown in FIG. 2, a plurality of cubic diagonally arranged diamonds are shown intermixed with a number of other diamonds which are of smaller size than the cubic particles.

Figure 5:
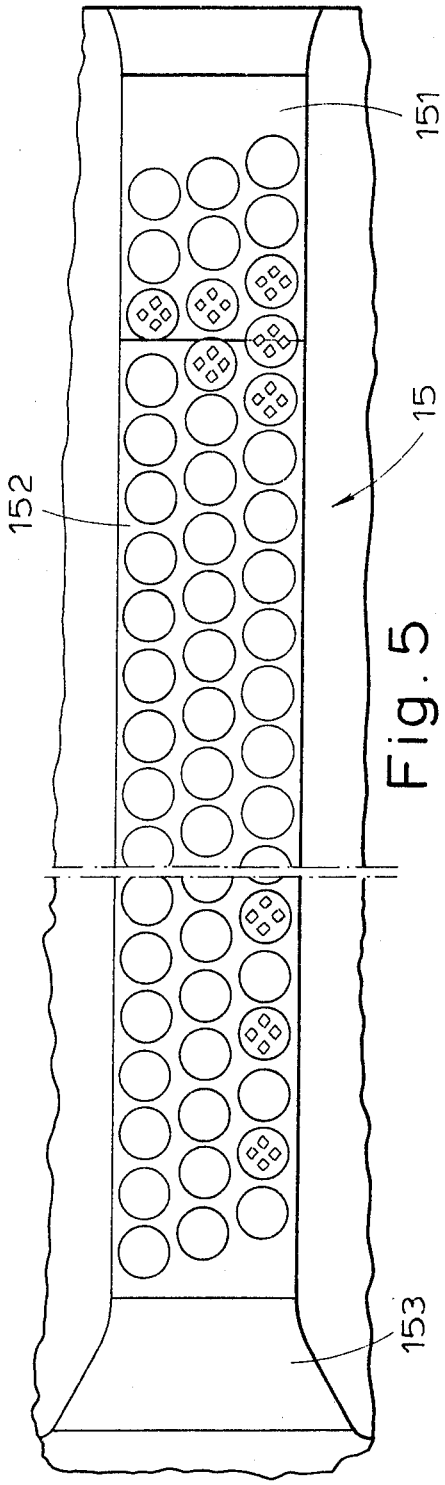
FIG. 5 is an enlarged plan view of a blade.

Referring to FIG. 5 it will be noted that of the nine plugs at the leading tapered surface of the blade, three contain diamond and that a further diamond containing plug is located at the junction of the surface 151 with the surface 152. There is a concentration of diamond containing plugs at the leading end of the surface 152 and also at the rear end of this surface on the side of the blade which leads during the clockwise motion of the stabilizer in the borehole as is usual in a drill string.

I claim:

1. An improvement in a stabilizer of the type having integral steel blades with preformed apertures into which are cold pressed plugs of hard material, the improvement comprising diamonds embedded in some of the plugs, said some plugs being less in number than the total number of plugs so that some plugs have diamonds embedded therein and the remaining plugs are free of diamonds, said diamonds each having a size between 1/20 and 2 carats and each being located at a plug outer surface to be presented outwardly of the blade.

2. A stabilizer according to claim 1, wherein each blade of the stabilizer has some plugs of plain cemented tungsten carbide and other plugs which contain diamonds held in a matrix of tungsten carbide, the plugs containing diamond being 3% to 20% of the total plugs on each blade.

3. A stabilizer according to claim 2, wherein the plugs containing diamond are located and concentrated in regions where the contours of the external surfaces of the blades change most sharply.

4. A stabilizer according to any one of claims 1, wherein each blade of the stabilizer has a tapered leading end and wherein plugs containing diamond are located and concentrated in that region of each blade where the tapered leading end merges with the part-cylindrical external surface of the blade.

5. A stabilizer according to any of claims 1, wherein the size of the diamond is in the range 1/20 to 2 carats.

6. A stabilizer according to claim 5, wherein each diamond containing plug has four or more diamonds at its outer face and in which the diamonds are cubic and orientated diagonally with respect to the intended direction of motion of the plug relative to the borehole wall.

7. A stabilizer according to claim 1, wherein each stabilizer blades has preformed holes filled with plugs of material harder than steel on both its outer surface and on its tapered leading end, and wherein of the plugs on the outer part-cylindrical surface of each blade not more than 25% have diamonds embedded therein.

8. A stabilizer according to claim 7, wherein of the plugs on the tapered leading end of the stabilizer blade at least 20% have diamonds embedded therein.

9. A stabilizer according to claim 8, wherein each blade also has preformed holes filled with plugs on a tapered trailing end and wherein of the plugs on the tapered trailing end of each blade not more than 25% have diamonds embedded therein.

10. A stabilizer according to claim 1, wherein the diamond is natural or synthetic or a crystalline substance with a hardness close to that of diamond such as cubic boron nitride.

11. A stabilizer according to claim 6, wherein each plug containing diamond is formed by cementing a mixture of tungsten carbide powders, 10% to 25% cobalt powder and diamonds under a pressure of at least 5 tons per square inch by application of a temperature in the range 1200° C to 1450° C held for between one and five minutes.

12. A stabilizer according to claim 6, wherein each plug containing diamond comprises a matrix of tungsten carbide, the diamonds being held in the matrix by means including an infiltration of metal alloy, preferably a copper-nickel-zinc alloy.

13. A plug for insertion into a stabilizer blade, the plug containing diamonds, wherein the diamonds are held in a matrix of tungsten carbide having an infiltrant of metal alloy, preferably a copper-nickel-zinc alloy.

14. A plug for insertion into a preformed hole formed in a stabilizer blade, the plug containing diamonds, wherein the plug is formed by cementing a mixture of tungsten carbide powders, 10% to 25% cobalt powder and diamonds under a pressure of at least 5 tons per square inch by application of a temperature in the range 1200° C to 1450° C held for between one and five minutes.

15. A plug according to claim 14, wherein the plug has four or more diamonds, each of 1/20 carat to 2 carats in size, located exposed at one end face of the plug.

16. An improvement in a stabilizer of the type which includes integral blades having a plurality of hard metal plugs seated in apertures defined in the blades, the improvement comprising at least one diamond embedded in each of selected ones of the plurality of plugs to be located on an outer surface of said selected plugs to be presented outwardly of said selected plug, said diamond containing plugs being less than the total number of plugs in the stabilizer so that some plugs have at least one diamond embedded therein and the remaining plugs are free of diamonds.

* * * * *